US005193896A

United States Patent [19]

Oberlander

[11] Patent Number: 5,193,896

[45] Date of Patent: Mar. 16, 1993

[54] LIGHTING DEVICE FOR PERSONAL USE

[76] Inventor: Seymour Oberlander, 9226 Greenwood Ave., Munster, Ind. 46321

[21] Appl. No.: 820,192

[22] Filed: Jan. 13, 1992

[51] Int. Cl.[5] ..... F21L 15/08

[52] U.S. Cl. ..... 362/103; 362/104; 362/186; 362/200; 362/205

[58] Field of Search ..... 362/103, 104, 105, 156, 362/200, 187, 186, 204, 102, 196, 226, 205, 206, 293, 257

[56] References Cited

U.S. PATENT DOCUMENTS

| | | | |
|---|---|---|---|
| 1,307,456 | 6/1919 | Prahar | 362/103 |
| 2,486,998 | 11/1949 | Szeklinski | 362/106 |
| 2,805,326 | 9/1957 | Schwartz | 240/59 |
| 3,508,044 | 4/1970 | Hochberg | 240/6.43 |
| 3,804,307 | 4/1974 | Johnston | 362/104 |
| 4,101,955 | 7/1978 | Dunah | 362/104 |
| 4,398,237 | 8/1983 | Doyel | 362/206 |
| 4,451,871 | 5/1984 | Kirkley et al. | 362/186 |
| 4,523,258 | 6/1985 | Morse et al. | 362/108 |
| 4,788,631 | 11/1988 | Fuller | 362/103 |

FOREIGN PATENT DOCUMENTS

| | | | |
|---|---|---|---|
| 264639 | 7/1964 | Australia | 362/103 |
| 891629 | 3/1962 | United Kingdom | 362/103 |

*Primary Examiner*—James C. Yeung
*Attorney, Agent, or Firm*—Hill, Steadman & Simpson

[57] ABSTRACT

A lighting device adapted for personal use, and having a frame structure, an electric lamp, a battery associated with the frame structure, a switch mechanism with which the lamp is associated and carried by the frame structure and having a movable switch arm supporting contacts connected with the lamp and operable for selectively making and breaking a lamp energizing circuit between the battery and the lamp by movable operation of the arm, and there being structure for attaching the device in place for use.

21 Claims, 4 Drawing Sheets

XIV
XVI
XVII
52
78
51
31
43
50
77
65
44
65a
63
67
33
69
68
64
32b,33
59
61
58
32a

LIGHTING DEVICE FOR PERSONAL USE

BACKGROUND OF THE INVENTION

The present invention relates to lighting devices or illuminating lamps which have special advantage for personal use. That is, the devices may be used in association with the person, such as strapped to a wrist, or hung on a belt, or hung in a convenient place on a bicycle, baby carriage, or the like.

Numerous and varied illuminating devices have been contrived and proposed in the prior art. Some of those devices have limited utility. Other of the prior devices may present undesirable complexities, or manufacturing difficulties, or other undesirable features.

SUMMARY OF THE PRESENT INVENTION

An important aim of the present invention is to provide a new and improved lighting device especially adaptable for personal use, and which is compact, neat in appearance, sturdy, and simple to manufacture and assemble.

Another object of the invention is to provide a new and improved lighting device, especially adaptable for personal use, which involves few and simple parts and which can be produced and supplied at low cost in mass production.

Still another object of the present invention is to provide a new and improved lighting device adaptable for personal use and which has an assembly of dielectric, preferably plastic, moldings and electrical components.

Pursuant to the principles of the present invention, there is provided a new and improved lighting device adaptable for personal use, comprising a frame structure, an electric lamp, a battery associated with the frame structure, a switch mechanism with which the lamp is associated and carried by the frame structure and having a movable switch arm supporting contact means connected with the lamp and operable for selectively making and breaking a lamp energizing circuit between the battery and the lamp by movable operation of the arm, and means for attaching the device in place for use.

The present invention also contemplates a new and improved device of this character having an advantageous coin battery power source, and mounting means for the battery.

There is further provided by the present invention a new and improved dome structure for such a device, and having means for improved illumination results.

The invention also provides a new and improved frame and associated structure in a lighting device of the kind described.

BRIEF DESCRIPTION OF THE DRAWINGS

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which.

DETAILED DESCRIPTION

Figure 2:
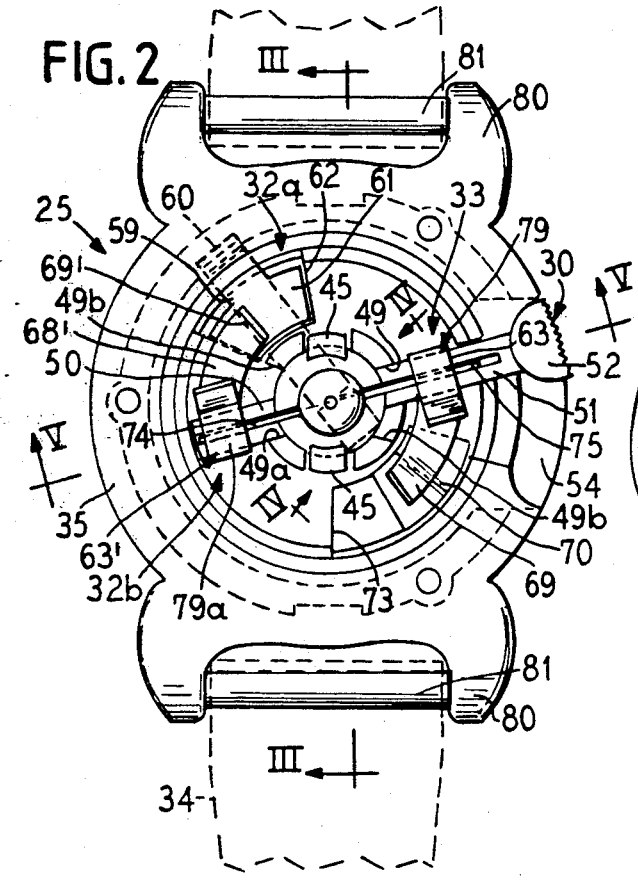
FIG. 2 is a top plan view of the device, with an enclosing dome removed.

As shown in FIGS. 1-5, one best mode of the lighting device, especially adapted for personal use, of the present invention, comprises a compact assembly 25 having a circular frame structure member 27, an electric lamp 28, a self-contained electrical power source battery 29, and a switch mechanism 30 with which the lamp 28 is associated.

The switch mechanism 30 is carried by the frame 27 and includes a movable switch arm means 31 (see also FIGS. 13 to 17) and associated contact means in the form of a positive contact assembly 32 comprising a fixed part **32*a* (see also FIGS. 22 to 24) and a movable part 32*b* which is of the same configuration (duplicative) as a negative contact 33 (see also FIGS. 18 to 21). The positive and negative contact means are connected with the lamp 28 and arranged for making and breaking a lamp energizing circuit between the battery 29 and the lamp 28 by movable operation of the switch arm 31**.

Means for removably attaching the device 25 in place for use comprises an adjustable and releasable wrist band or strap 34, which is attached to an annular housing member 35 embracing and attached to the frame member 27 and cooperates therewith to retain a lamp enclosing translucent dome 37 in the assembly. Removable closure means for the bottom of the device 25 comprises a preferably snap-in, snap-out cover 38.

More particularly, the frame member 27 (FIGS. 3, 5 and 8–12), comprises a one-piece dielectric, preferably plastic, molding cooperatively contoured to interfit neatly and compactly with the associated components of the device 25. To this end, the frame member 27 includes a platform 39 which is circular in shape and has a central lamp socket 40 defined within a generally cup-shaped upstanding wall 40*a*, and within which a base disk 41 on the lamp is received. A short vertical post 42 extends vertically upwardly integrally from the platform 39 within the socket 40 and engages as a bearing stop centrally under the lamp base disk 41, which is of larger diameter than the lamp 28.

For retaining the lamp 20 centered on the bearing post 42, the switch arm 31 (FIGS. 2, 3 and 13–15) has intermediate its length a substantially annular collar 43 which is neatly received within the socket 40 and with the lamp base 41 received centrally within the collar 43. Means comprising an overhanging generally annular radially inwardly projecting shoulder 44 overlies the laterally projecting rim of the base disk 41.

Retention of the collar 43 oscillatably within the socket 40 is effected by means of a pair of diametrically opposite, upstanding retaining fingers 45 integral with the platform 39 and accommodated within clearance slots 47 in the wall 40*a*. Each of the retaining fingers 45 has a cammed retaining hook head 48 which is retainingly engageable with the upper edge of the wall 43 and has a lead-in cam surface 48 which facilitates snapping the collar 43 and thereby the arm 31 into place within the socket 40, wherein the lower edge of the collar 43 is held slidably, movably and more particularly oscillatable on the platform 39.

Opposite end portions of the switch arm 31 extend through respective clearance slots 49 in the wall 40*a*. The slots 49 are located to accommodate the arm on an axis midway between the retaining fingers 45. A relatively short end portion 50 of the arm 31 extends through one of the slots 49 and a longer opposite end portion 51 extends through the other, opposite clearance slot 49.

Figure 5:
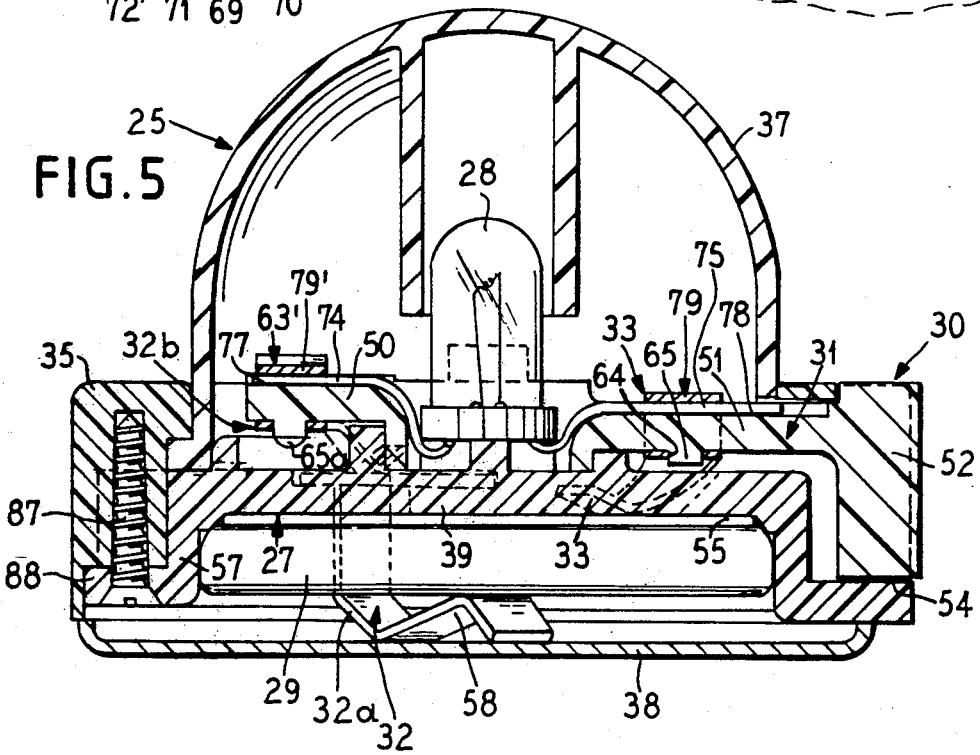
FIG. 5 is an enlarged vertical sectional detail view taken substantially along the line V—V in FIG. 2.
Figure 8:
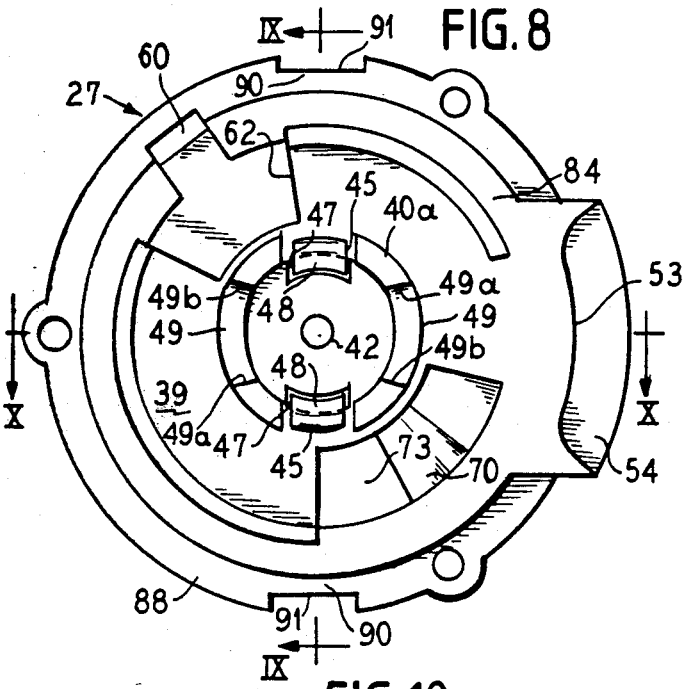
FIG. 8 is a plan view of a frame structure component of the device.
Figure 9:
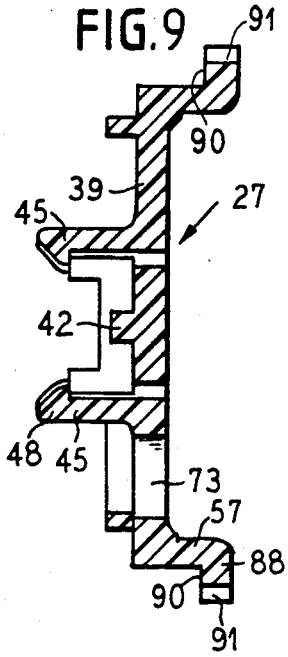
FIG. 9 is a sectional detail view taken substantially along the line IX—IX in FIG. 8.
Figure 10:
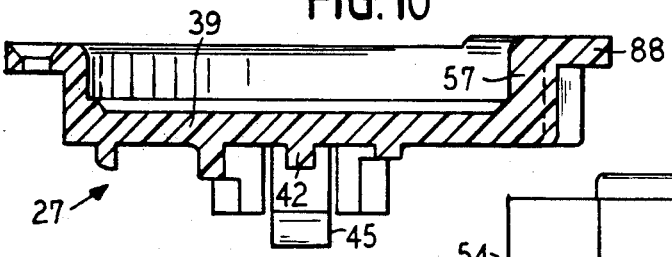
FIG. 10 is a sectional detail view taken substantially along the line X—X in FIG. 8.
Figure 11:
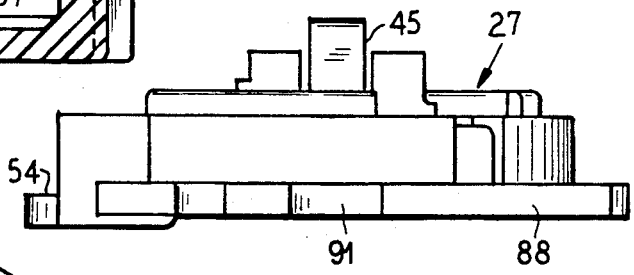
FIG. 11 is a side elevational view of the frame component of FIG. 8.
Figure 12:
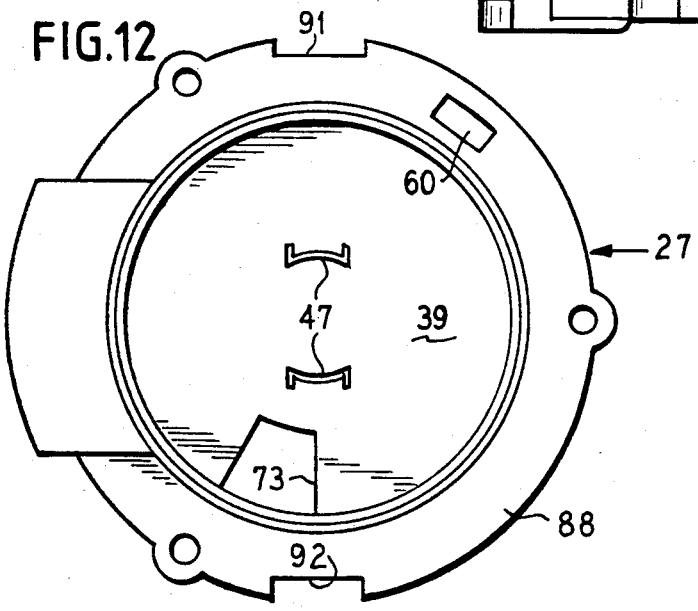
FIG. 12 is a bottom plan view of the frame component.

On the distal end of the longer portion 51 of the arm 31, there is desirably provided means for facilitating operational movement of the switch arm, and herein comprising a digitally manipulatable handle 52 which projects downwardly and is maneuverable from side-to-side within a reentrant clearance 53 providing a threshold 54 projecting laterally on the frame member 27. The threshold 54 protects the handle 5 against being depressed with damaging force, although as best seen in FIG. 5, the lower edge of the handle normally rides clear of the threshold.

Figure 1:
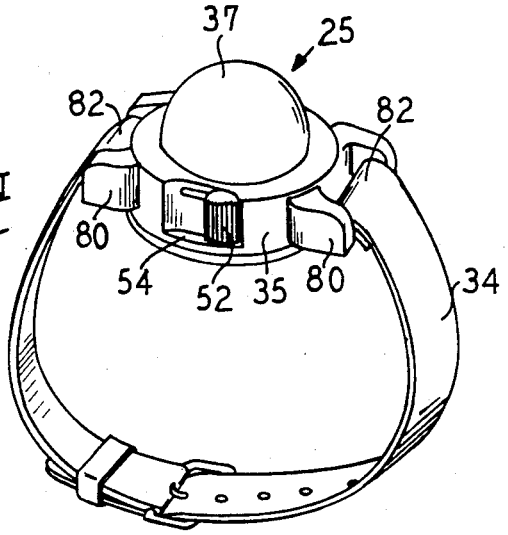
FIG. 1 is a perspective view of a lighting device according to the present invention, especially adapted for wearing on a person's wrist.

The clearance slots 49 in the wall 40*a* are of a length to permit the switch arm 31 to be swung oscillatably between a switch open and a switch closed position. In the switch open position as seen in FIGS. 1 and 2, stop shoulders 49*a* defining one side of the slots 49, stop the arm 31 in that position. In the switch closed position opposite stop shoulders 49*b* stop the switch arm.

Construction and arrangement of the positive contact assembly 32, is such that the battery 29 is held by the contact part 32*a* in position within a battery-housing recess 55 opening downwardly under the platform 39 of the frame member 27. This recess is defined by a rim flange 57 slidably receptive of the edge of battery 29. The contact part 32*a* is fixed in position so that an upwardly arched and biased spring finger 58 on its distal end portion thrusts against the bottom surface of the coin battery 29 and biases the battery upwardly so that its upper face pushes firmly against the bottom of the platform 29. For holding the contact part 32*a* fixedly in place, it has an angular return bent gripping loop 59 which extends through a slot 60 (FIGS. 8 and 12) in the rim portion of the frame 27, with an integral terminal contact wiper panel 61 received in a complementary upwardly opening recess 62 in the frame member.

Figure 4:
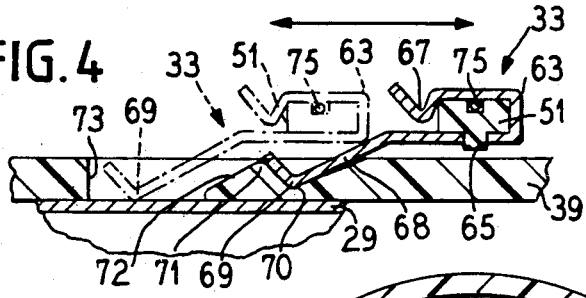
FIG. 4 is a fragmentary sectional detail view taken substantially along the line IV—IV in FIG. 2.
Figures 13, 14, 15, 16, 17, 18, 19, 20, 21, 22, 23, 24:
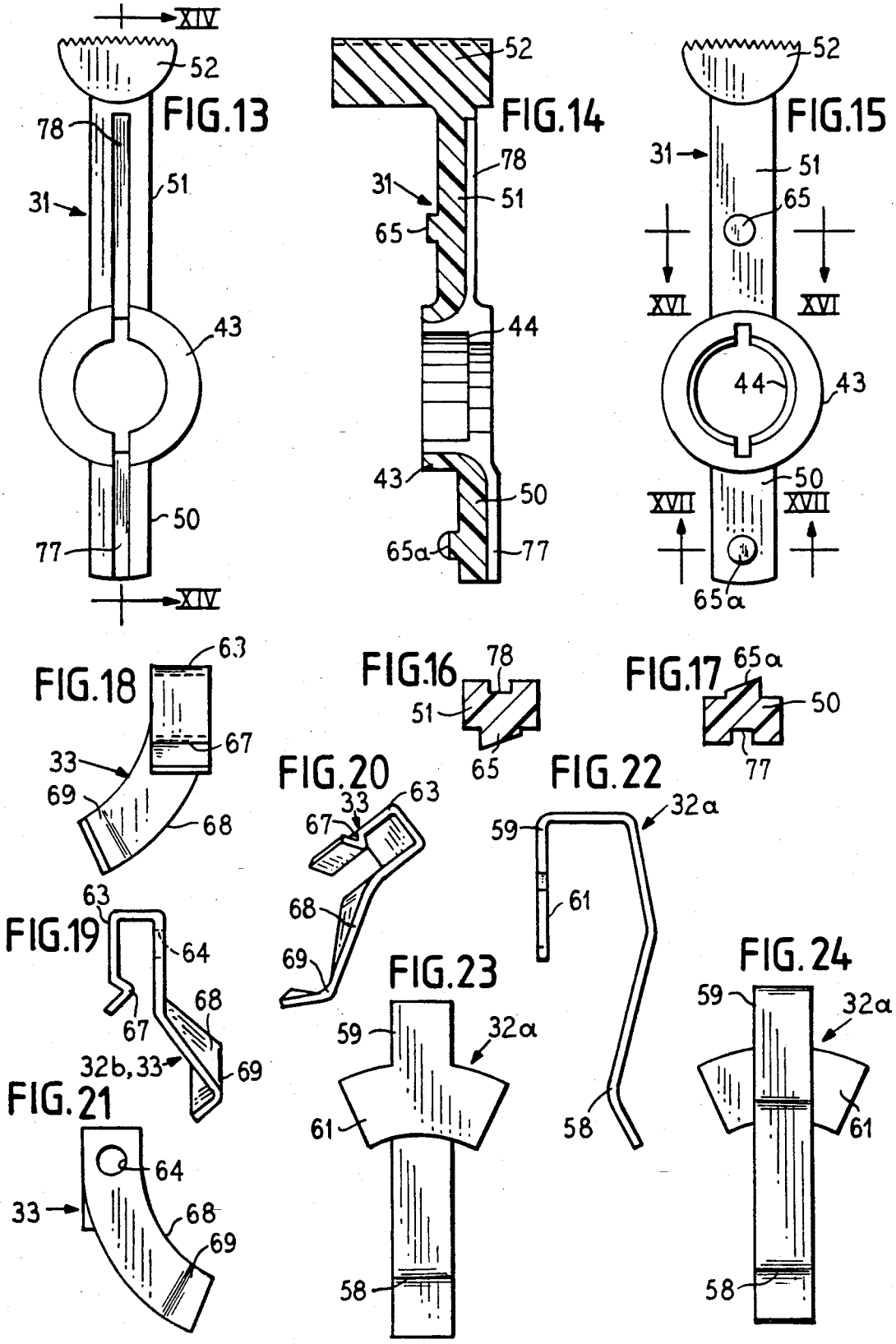
FIG. 13 is a plan view of the switch arm of the device.
FIG. 14 is a sectional detail view taken substantially along the line XIV—XIV in FIG. 13.
FIG. 15 is a bottom plan view of the arm.
FIG. 16 is a sectional detail view taken substantially along the line XVI—XVI in FIG. 15.
FIG. 17 is a sectional detail view taken substantially along the line XVII—XVII in FIG. 15.
FIG. 18 is a plan view of a dual function contact member adapted to serve both as a movable negative contact, as such, and as a movable part of a positive contact means assembly.
FIG. 19 is a side elevational view of the member in FIG. 18.
FIG. 20 is a perspective view of the member in FIG. 18.
FIG. 21 is a bottom plan view of the member in FIG. 18.
FIG. 22 is a side elevational view of a stationary contact part of the positive contact means assembly.
FIG. 23 is a top plan view of the part in FIG. 22.
FIG. 24 is a bottom plan view of the part in FIG. 22.

The negative contact 33 has an angular attachment loop portion 63 at one end constructed and arranged to complementally embrace the longer portion 51 of the switch arm 31, with a socket hole 64 in a part of the loop portion receiving a retaining boss 65 on the arm portion 51 therethrough, and retaining the contact member against displacement longitudinally along the arm portion 51. Firm lateral gripping of the arm portion 51 by the loop 63 is assured by means of a terminal spring detent 67 on the loop portion 63 (FIGS. 2, 4 and 19). A spring contact leg 68 at the opposite end of the contact member 33 is biased toward the platform 39.

In the off position of the switch mechanism 30, as shown in FIGS. 1, 2 and in full line in FIG. 4, a detent portion 69 is biased to engage in a complementary detent socket 70 in the platform 39. Through this arrangement, the switch arm 31 is held in the off position until it is deliberately swung into a lamp-on switch position wherein the detent 69 is cammed out of the recess 70 and over a ridge 71 and snappingly runs down an acceleration ramp 72 into electrical contact with the top of the battery 29 which is exposed for this purpose through a window opening 73 in the platform 39, as shown in phantom outline in FIG. 4. A reverse maneuver of the switch arm 31 causes the detent 69 to be returned to the lamp-off position of the switch mechanism 30.

All of the contact parts 32*a*, 32*b* and 33 are formed up as simple stampings from suitable electronically conductive material.

In order to complete a lamp illuminating electrical circuit with the lamp 28, the lamp is provided with a pair of oppositely extending stiff wire terminals 74 and 75 received longitudinally in respectively a lamp terminal receiving groove 77 in the short switch arm portion 52 and a corresponding lamp terminal groove 78 in the long portion 51 of the arm 31. The grooves 77 and 78 are slightly shallower than the diameter of the terminals 74 and 75 so that an overlying portion 79 of the loop 63 of the terminal 33 will make firm electrical contact with the terminal 75. Likewise, a firm electrical contact is made with the lamp terminal 74 by an electrically contacting overlying portion 79' of loop 63' of the electrical contact part 32*b*. As best seen in FIG. 2, the loop portion 63' of the contact part 32*b* grips the shorter switch arm leg 50 and interconnects with a boss 65*a*, the same as the contact loop 63 of the contact 33 grips the longer switch arm portion 51 and boss 65.

However, with respect to the contact part 32*b*, its spring leg 68' biases its detent portion 69' against the positive contact wiper panel 61. The width of the clearance recess 62 in the platform 39, and the width of the panel 61 are sufficient to maintain an electrical contact of the detent 69 constant and provide a range of continuous sliding engagement in all positions of the switch arm 31.

The means for attaching the wrist band or strip 34 to the device includes oppositely projecting spaced ears 80 on the housing member 35. Attachment pins 81 carried by the ears 80 engage through respective loops 82 on the opposite ends of the wrist band.

About its upper inner side, the annular housing member 35 has a downwardly facing annular reentrant shoulder 83 cooperating with a complementary upwardly facing annular reentrant shoulder 84 on the frame member 27 for retainingly clamping an annular outwardly projecting mounting flange 85 on the lower edge of the dome 37. Retaining screws 87 secure a lateral base flange 88 of the frame member 27 to the housing ring member 35.

Figure 3:
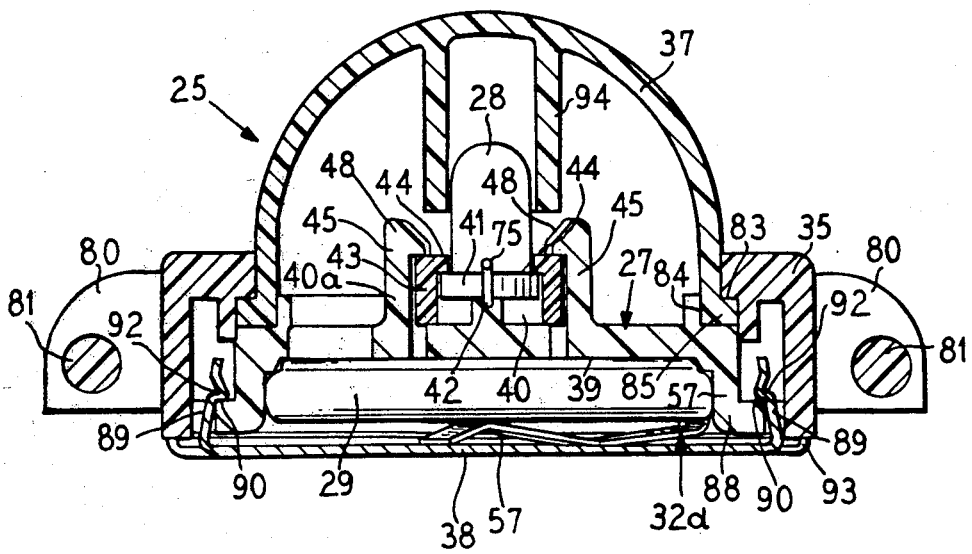
FIG. 3 is an enlarged vertical sectional detail view taken substantially along the line III—III in FIG. 2.

Means for retaining the bottom cover 38 in place in the assembly comprise a pair of upstanding inwardly biased spring fingers 89 on the edge of the cover and which are adapted to snap into engagement with respective shoulders 90 along vertical receiving recesses 91 in the base flange 88. For snapping engagement with the shoulders 90, the fingers have detents 92. The arrangement is such that the detents 92 cammingly draw the bottom plate 38 upwardly so that an upturned rim 93 on the plate is drawn firmly up against the lower edge of the housing ring 35, as best seen in FIGS. 3 and 5.

By preference, the dome 37 is constructed from translucent plastic material which may be wholly or partially transparent, as may be preferred. For improving diffusion of light from the lamp 28, the dome 37 is preferably provided with diffuser means 94, desirably comprising an integrally molded centrally depending diffuser tube 94 projecting downwardly from the inner top of the dome 37 and of a diameter to receive in surrounding relation at least substantially elongated upper portion of the lamp 28 which may be, as shown, of generally cylindrical elongated form having a rounding top.

Figure 6:
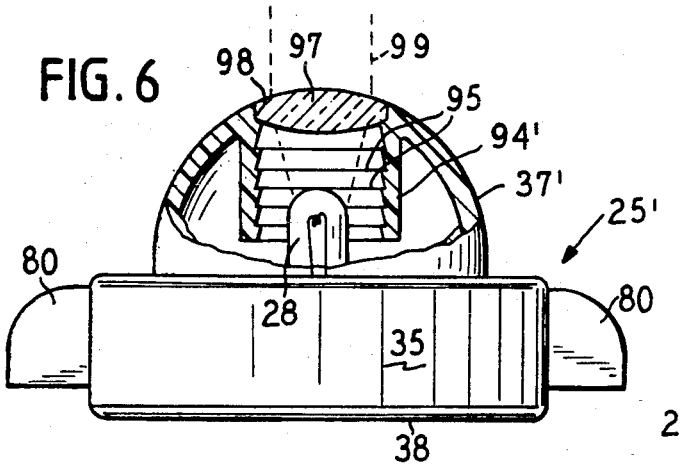
FIG. 6 is an elevational view, partially in section, showing a modification in the dome structure of the device.

Optional illumination improving means are depicted in FIG. 6, wherein the device 25' is essentially the same as the device 25, but the dome 37' has modifications as compared to the dome 37. To this end, the dome 37' is shown as having a diffuser tube means 94' equipped with enhanced diffusing means in the form of a vertical series of annular, generally saw-tooth angularly related diffuser ribs 95 on its inner vertical surface.

Optionally, the diffuser tube 94' (as well as the diffuser tube 94) may be provided with a light focusing lens 97. Whereas the lens 97 may be molded integrally with the selected dome 37 or 37', it may also be separately formed, from means such as glass and cemented into an annular seat 98 in the crown of the associated dome concentric with the associated light diffusing tube. Thereby, as shown schematically in dash outline in FIG. 6, light from the lamp 28 can be focused into a generally columnar beam 99.

Figure 7:
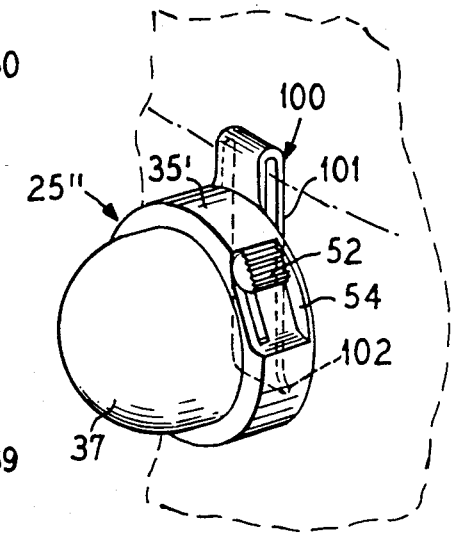
FIG. 7 is a perspective view showing the device equipped with a clip for attachment to person's belt or other convenient place.

Means other than the wristband or strap 34 may be provided for attaching the device of the present invention in place for use. For example, in FIG. 7 is shown the provision of an attachment clip 100 which may be provided on the housing ring 35' of a device 25'' which in other respects desirably comprises substantially the construction described in connection with the form of the device shown in FIG. 1. The clip 100 includes a return bent resilient clip finger 101 which cooperates with the back of the device, e.g. the back or bottom cover plate 38. At its distal end, the clip finger 101 desirably has a cam lead-in terminal 102.

It will be apparent that various modifications and/or additions may be made in the apparatus of the invention without departing from the essential feature of novelty involved, which are intended to be defined and secured by the appended claims.

I claim as my invention:

1. A lighting device adapted for personal use, comprising:
   - a frame structure providing a platform having an upper side with a lamp socket opening upwardly thereon and also having a lower side with a battery cavity opening downwardly therein;
   - an electric lamp having a base in said lamp socket;
   - a battery in said battery cavity of said frame structure;
   - a switch mechanism carried on the upper side of said platform and having a movable switch arm attached to said lamp base and supporting contact means connected with the lamp and operable for selectively making and breaking a lamp energizing circuit between the battery and the lamp by movable operation of the arm;
   - means for attaching said frame structure in place for use;
   - said battery comprising a coin battery and means for mounting the battery in said cavity;
   - a translucent dome structure enclosing said lamp and means for securing the dome structure in place.

2. A device according to claim 1, wherein said means for attaching said frame structure comprises a housing encircling and attached to and about said frame structure.

3. A device according to claim 1, including biasing spring means for retaining said battery in said recess.

4. A device according to claim 3, wherein said biasing spring means is part of said switch mechanism.

5. A device according to claim 4, including a removable plate enclosing said battery within said recess and biasing said spring means.

6. A device according to claim 1, wherein said lamp has oppositely extending wire terminals, and said switching arm has grooves therein within which said terminals are engaged, and with which said contact means makes contact.

7. A device according to claim 6, wherein said arm is movable with a swinging motion, said platform has means for oscillatably supporting said base on said lamp, and said terminals provide a connection with said arm so that the lamp oscillates with swinging motions of said arm.

8. A lighting device adapted for personal use, comprising:
   - a frame structure providing a platform having an upper side with a lamp socket opening upwardly thereon and also having a lower side with a battery cavity opening downwardly therein;
   - an electric lamp having a longitudinal axis base rotatably mounted in said lamp socket;
   - a battery mounted in said cavity of said frame structure;
   - a switch mechanism carried on the upper side of said platform and having a movable switch arm supporting contact means connected with the lamp and operable rotatably about said axis for selectively making and breaking a lamp energizing circuit between the battery and the lamp by said movable rotatably operation of the arm about said axis; and means for attaching said frame structure in place for use.

9. A device according to claim 8, wherein said means for attaching said frame structure comprises a housing encircling and attached to and about said frame structure.

10. A device according to claim 8, including biasing spring means for retaining said battery in said recess.

11. A device according to claim 10, wherein said biasing spring means is part of said switch mechanism.

12. A device according to claim 11, including a removable plate enclosing said battery within said recess and biasing said spring means.

13. A device according to claim 8, wherein said lamp has oppositely extending wire terminals, and said switch arm has grooves therein within which said terminals are engaged, and with which said contact means makes contact.

14. A device according to claim 13, wherein said arm is movable with a swinging motion, said platform has means for oscillatably supporting a base on said lamp, and said terminals provide a connection with said arm so that the lamp oscillates with swinging motions of said arm.

15. A lighting device adapted for personal use, comprising:

a frame structure providing a platform having an upper side with a lamp socket opening upwardly thereon and also having a lower side with a battery cavity opening downwardly therein;

an electric lamp having a base in said lamp socket;

a battery in said battery cavity of said frame structure;

a switch mechanism carried on the upper side of said platform and having a movable switch arm attached to said lamp base and supporting contact means connected with the lamp and operable for selectively making and breaking a lamp energizing circuit between the battery and the lamp by movable operation of the arm;

means for attaching said frame structure in place for use;

a translucent dome structure enclosing said lamp; and means on said dome structure for controlling light dispersion from said lamp comprising a tubular light diffusing means projecting downwardly from the inside of said dome structure at least partially surrounding said lamp and having its lower end spaced above said platform.

16. A device according to claim 15, wherein said tubular means includes light diffusing ribs.

17. A device according to claim 16, including a light focusing lens in the crown of said dome structure and centered with respect to said tubular means.

18. A device according to claim 15, including a light focusing lens at the upper end of said tubular means.

19. A device according to claim 15, wherein said dome structure has a lateral base flange, and means for attaching said base flange to said frame structure.

20. A device adapted for personal use, comprising a frame structure having platform means and comprising:

an electric lamp having a base;

said platform means having means for oscillatably supporting said lamp base;

a battery supported by said platform means;

a switch mechanism carried by said platform means and having a switch arm movable with a swinging motion;

said lamp having oppositely extending wire terminals; and said switch arm having grooves therein within which said terminals are engaged, and said terminals providing a connection with said arm so that the lamp oscillates with swinging motions of said arm.

21. A device adapted for personal use, comprising a frame structure having platform means, and comprising:

an electric lamp having a base;

said platform means having means for supporting said lamp base on a predetermined axis;

a battery supported by said platform means;

a switch mechanism carried by said platform means and having a switch arm movable about said axis with a swinging motion; and said switch arm having electrical contact means on portions of the switch arm at opposite sides of said axis for controlling electrical operating connections between said lamp base and said battery in the swinging motion of said switch arm.

* * * * *